US012318680B2

(12) United States Patent
Lin

(10) Patent No.: US 12,318,680 B2
(45) Date of Patent: Jun. 3, 2025

(54) SNOWBOARD EDGE TUNER

(71) Applicant: Chengchuan Lin, Fujian (CN)

(72) Inventor: Chengchuan Lin, Fujian (CN)

( * ) Notice: Subject to any disclaimer, the term of this patent is extended or adjusted under 35 U.S.C. 154(b) by 307 days.

(21) Appl. No.: 18/127,008

(22) Filed: Mar. 28, 2023

(65) Prior Publication Data

US 2023/0310972 A1 Oct. 5, 2023

(30) Foreign Application Priority Data

Apr. 2, 2022 (CN) ..... 202220770090.2

(51) Int. Cl.
*A63C 11/06* (2006.01)
*B24B 3/00* (2006.01)

(52) U.S. Cl.
CPC ..... *A63C 11/06* (2013.01); *B24B 3/006* (2013.01)

(58) Field of Classification Search
CPC ..... A63C 11/06; A63C 11/00; A63C 11/04; B24B 3/006; B24B 3/00
USPC ..... 76/82, 83
See application file for complete search history.

(56) References Cited

U.S. PATENT DOCUMENTS 4,850,252 A * 7/1989 Sewell ..... A63C 11/06 76/83
5,485,768 A * 1/1996 Vermillion ..... A63C 11/06 76/83
6,260,441 B1 * 7/2001 Landl ..... B23D 67/12 76/83
6,386,068 B1 * 5/2002 Weissenborn ..... A63C 11/06 76/83
6,634,256 B2 * 10/2003 Weissenborn ..... A63C 11/06 76/83

* cited by examiner

*Primary Examiner* — Phong H Nguyen

(57) ABSTRACT

A snowboard edge tuner, including a locking mechanism and a case having a base and a connecting base mutually connected; a first through hole passing through the connecting base and a second through hole passing through both the base and the connecting base are in communication with each other; the locking mechanism includes a sliding block and a first rotating component; the sliding block includes a first pressure plate, a second pressure plate and a first inclined surface; the base includes a second inclined surface corresponding to the first inclined surface; the first rotating component is rotatably fitted on the case, rotates and drives the sliding block to move along the second inclined surface, such that the first pressure plate presses against a sharpening block in the first through hole or the second pressure plate presses against the sharpening block in the second through hole.

13 Claims, 8 Drawing Sheets

SNOWBOARD EDGE TUNER

FIELD OF THE INVENTION

The invention relates to the technical field of grinding devices, in particular relates to a novel snowboard edge tuner.

BACKGROUND OF THE INVENTION

A snowboard edge tuner is a device that uses a grinding stone to create sharpened edges of a snowboard. It generally includes a case formed by an installation part and a positioning part, and a sharpener formed by a sharpening block. The installation part and the positioning part are perpendicular to each other, and the sharpening block is fixedly installed on the installation part.

The sharpening block in a prior art snowboard edge tuner is installed in one direction only and is therefore only used in one single direction only, which is inflexible.

BRIEF SUMMARY OF THE INVENTION

To solve the aforementioned problems, the present invention provides a novel snowboard edge tuner which provides more installing positions of the sharpening block to meet different needs.

The technical solution is as follows:

A novel snowboard edge tuner, comprising a case and a locking mechanism; the case comprises a base and a connecting base; the base is connected to the connecting base; the case also comprises a first through hole passing through the connecting base, and a second through hole passing through both the base and the connecting base; the first through hole and the second through hole are in communication with each other; the locking mechanism comprises a sliding block and a first rotating component; the sliding block is provided with a first pressure plate movably fitted in the first through hole, a second pressure plate movably fitted in the second through hole, and a first inclined surface slidably cooperative with the base; the base is provided with a second inclined surface slidably cooperative with the first inclined surface; the first rotating component is rotatably fitted on the case, axially limited by the case and further threaded to the sliding block; when the first rotating component rotates, the first rotating component drives the sliding block to slide along the second inclined surface, such that the first pressure plate is configured to press against a sharpening block disposed in the first through hole, or the second pressure plate is configured to press against the sharpening block alternatively disposed in the second through hole.

The first through hole extends in a horizontal direction, and the second through hole extends in a vertical direction.

The base is formed by a front case, a rear case, and a front cover; the connecting base is formed by a rear cover which covers the front case and the rear case; the first through hole and the second inclined surface are provided on the rear cover; an upper part and a lower part of the second through hole are respectively provided on the rear cover and the rear case.

The novel snowboard edge tuner also comprises an adjusting mechanism arranged between the front case and the front cover to control a relative angle between the front case and the front cover.

An installing chamber is formed between the front case and the front cover; the adjusting mechanism comprises a second rotating component provided in the installing chamber and also comprises a protruding column provided on a side of the front cover facing the second rotating component; the second rotating component is provided with a helical surface; the protruding column abuts against different positions of the helical surface during rotation of the second rotating component; the front cover is pivoted to the front case.

A free end of the protruding column is a spherical head; the helical surface is provided with a plurality of spherical grooves at equiangular intervals, and the spherical head is movably fitted in different spherical grooves when the second rotating member rotates; the adjusting mechanism also comprises a fixed screw provided at a rotating shaft of the second rotating component, and a spring provided between an end of the fixed screw and said front cover; the spring provides elastic force such that the front cover biased to the front case.

The first pressure plate and the second pressure plate are respectively provided with a first anti-skid pattern and a second anti-skid pattern.

The first rotating component comprises a knob and a connecting part; the knob covers an end of the connecting part; another end of the connecting part is threaded to the sliding block.

A bottom side of the second pressure plate is provided with a connecting plate, on which a nut is fixedly connected; said another end of the connecting part is threaded to the nut.

The second through hole has a reduced diameter portion along its depth, and the reduced diameter portion is defined as a limiting hole; a limiting slot is provided in a middle portion of the connecting part; an inner circumferential wall of the second through hole defining the reduced diameter portion is positioned inside the limiting slot.

A depth of the limiting slot is greater than a diameter difference between the limiting hole and the connecting part.

The sliding block is provided with a third inclined surface parallel to the first inclined surface; the connecting base is provided with a fourth inclined surface slidably cooperative with the third inclined surface.

The fourth inclined surface is positioned on an inner upper surface of the first through hole.

By adopting the above technical solution, the first through hole and the second through hole are provided on the case to provide two positions to install the sharpening block; the first inclined surface of the sliding block cooperates with the second inclined surface of the case, such that when the first rotating component rotates, the first rotating component drives the first pressure plate or the second pressure plate of the sliding block to fix the sharpening block inserted in the corresponding first through hole or second through hole. Hence, the grinding surface of the sharpening block can face different directions and meet different usage requirements.

DETAILED DESCRIPTION OF THE INVENTION

Figure 1:
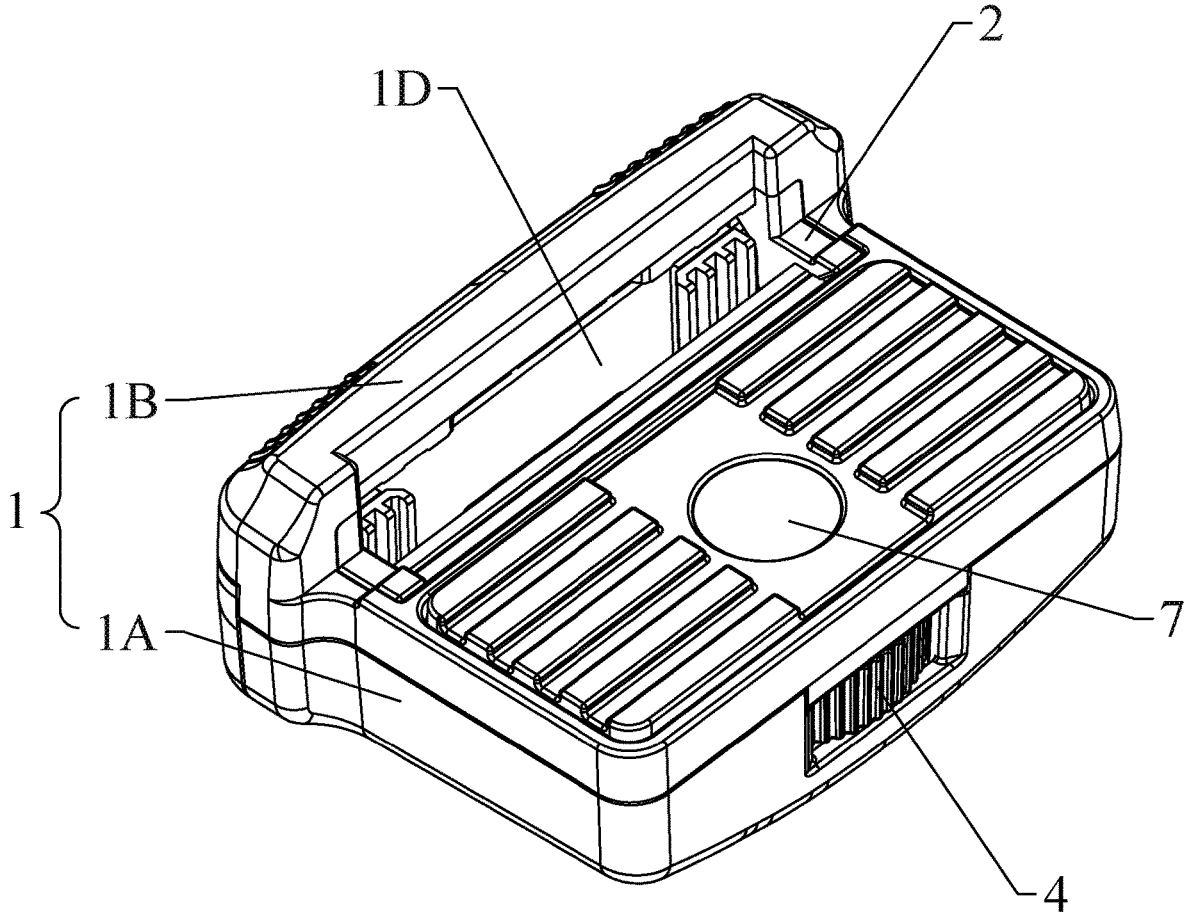
FIG. 1 shows a first perspective view of the embodiment of the present invention.
Figure 2:
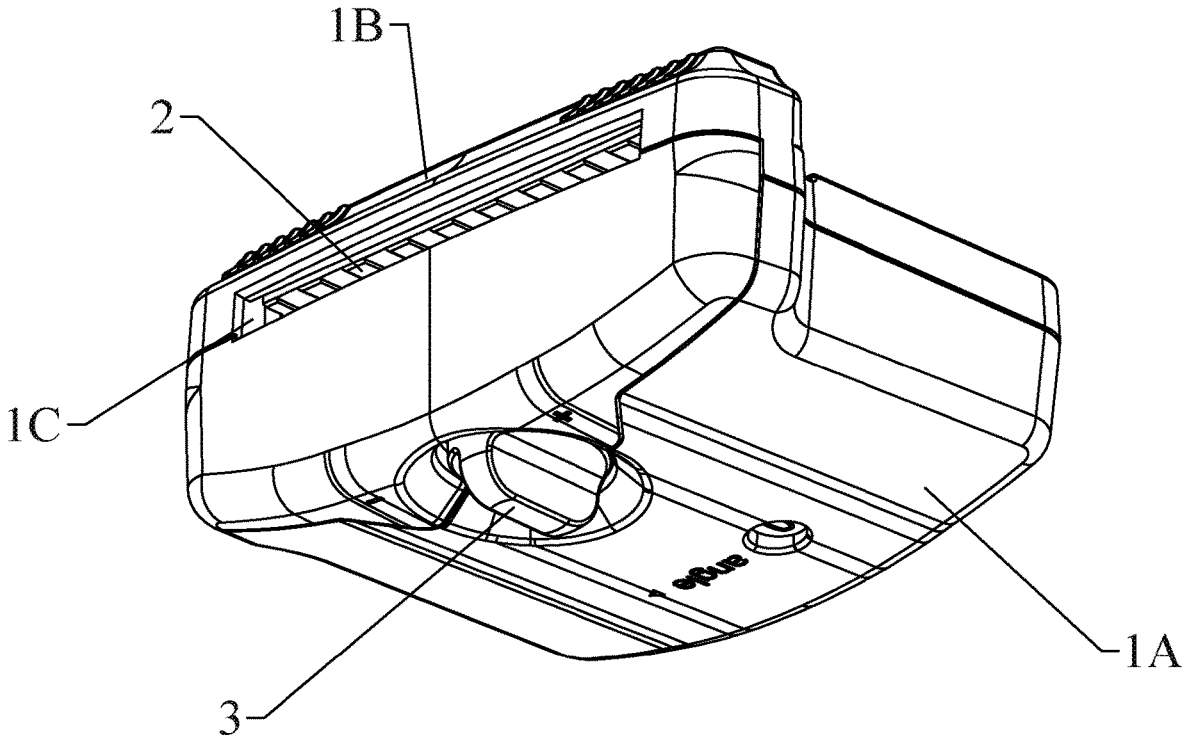
FIG. 2 shows a second perspective view of the embodiment of the present invention.
Figure 3:
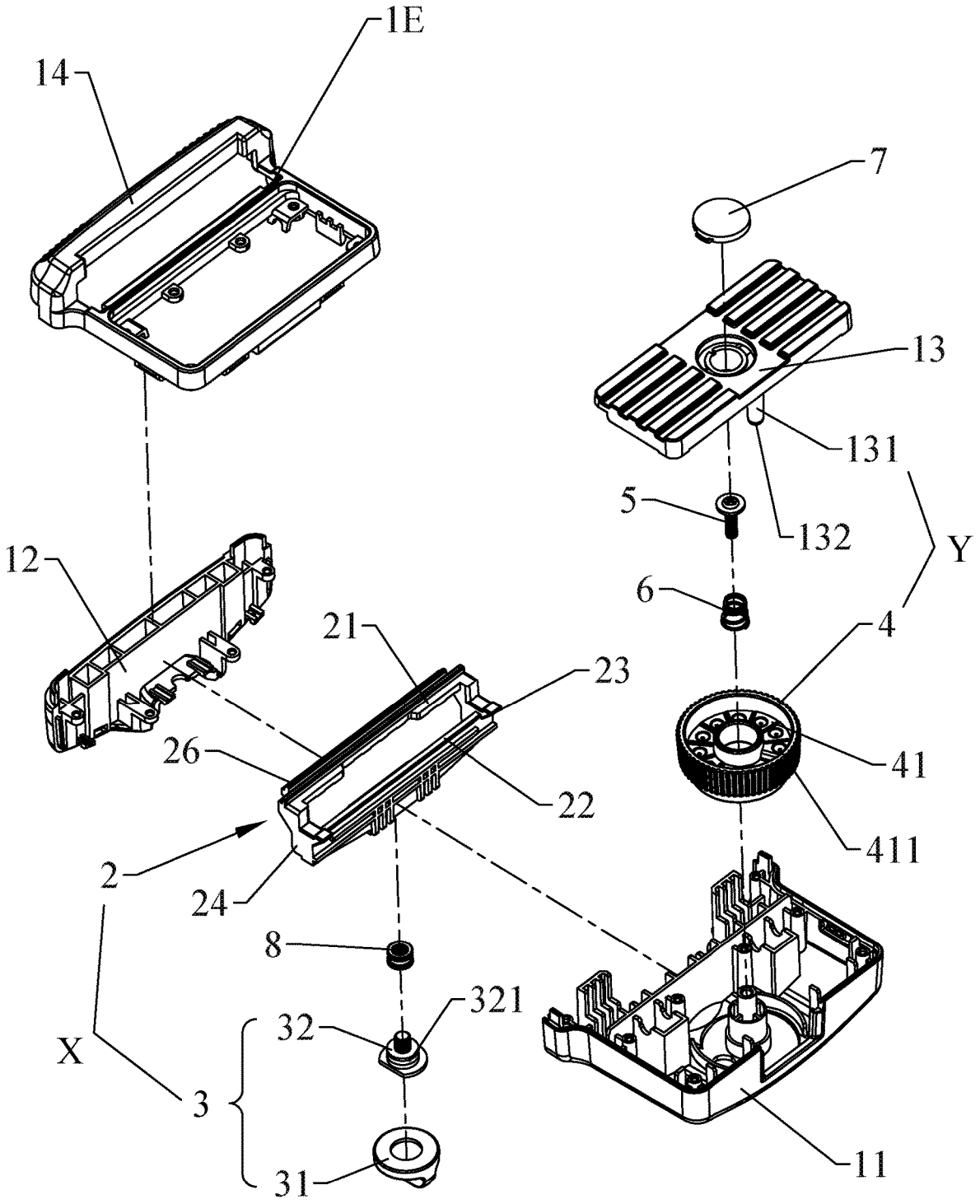
FIG. 3 shows a first exploded view of the embodiment of the present invention.
Figure 4:
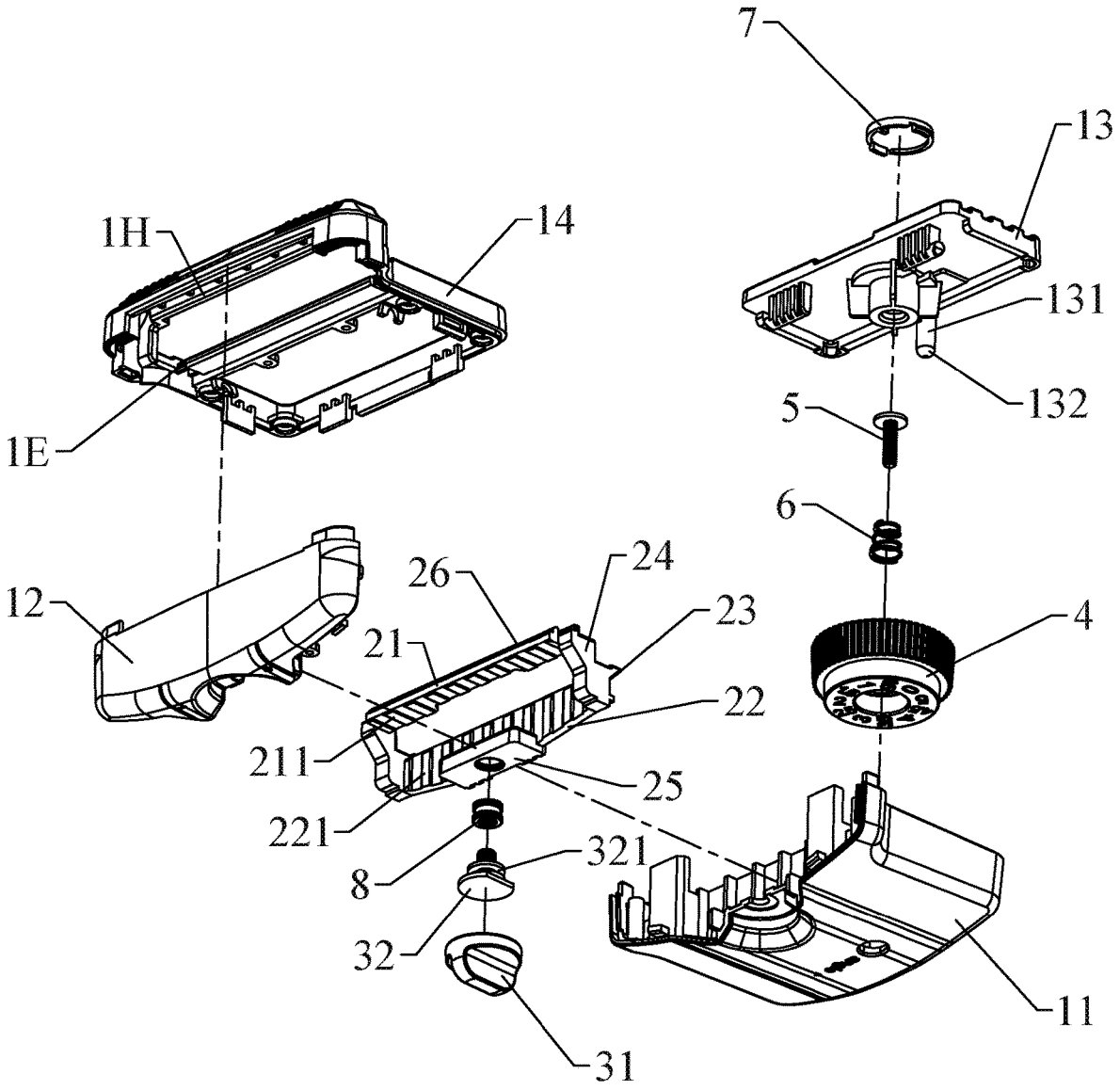
FIG. 4 shows a second exploded view of the embodiment of the present invention.

To further explain the technical solution of the present invention, the present invention will be described in detail below through a specific embodiment.

The present invention discloses a novel snowboard edge tuner, which comprises a case 1 and a locking mechanism X;

The case 1 comprises a base 1A and a connecting base 1B; the base 1A is connected to the connecting base 1B; the case also comprises a first through hole 1C passing through the connecting base 1B, and a second through hole 1D passing through both the base 1A and the connecting base 1B; the first through hole 1C and the second through hole 1D are in communication with each other;

The locking mechanism X comprises a sliding block 2 and a first rotating component 3; the sliding block 2 is provided with a first pressure plate 21 movably fitted in the first through hole 1C, a second pressure plate 22 movably fitted in the second through hole 1D, and a first inclined surface 23 slidably cooperative with the base 1A; the base 1A is provided with a second inclined surface 1E slidably cooperative with the first inclined surface 23; the first rotating component 3 is rotatably fitted on the case 1, axially limited by the case 1 and further threaded to the sliding block 2;

When the first rotating component 3 rotates, the first rotating component 3 drives the sliding block 2 to slide along the second inclined surface 1E, such that the first pressure plate 21 is configured to press against a sharpening block 9 disposed in the first through hole 1C, or the second pressure plate 22 is configured to press against the sharpening block 9 alternatively disposed in the second through hole 1D.

Figure 5:
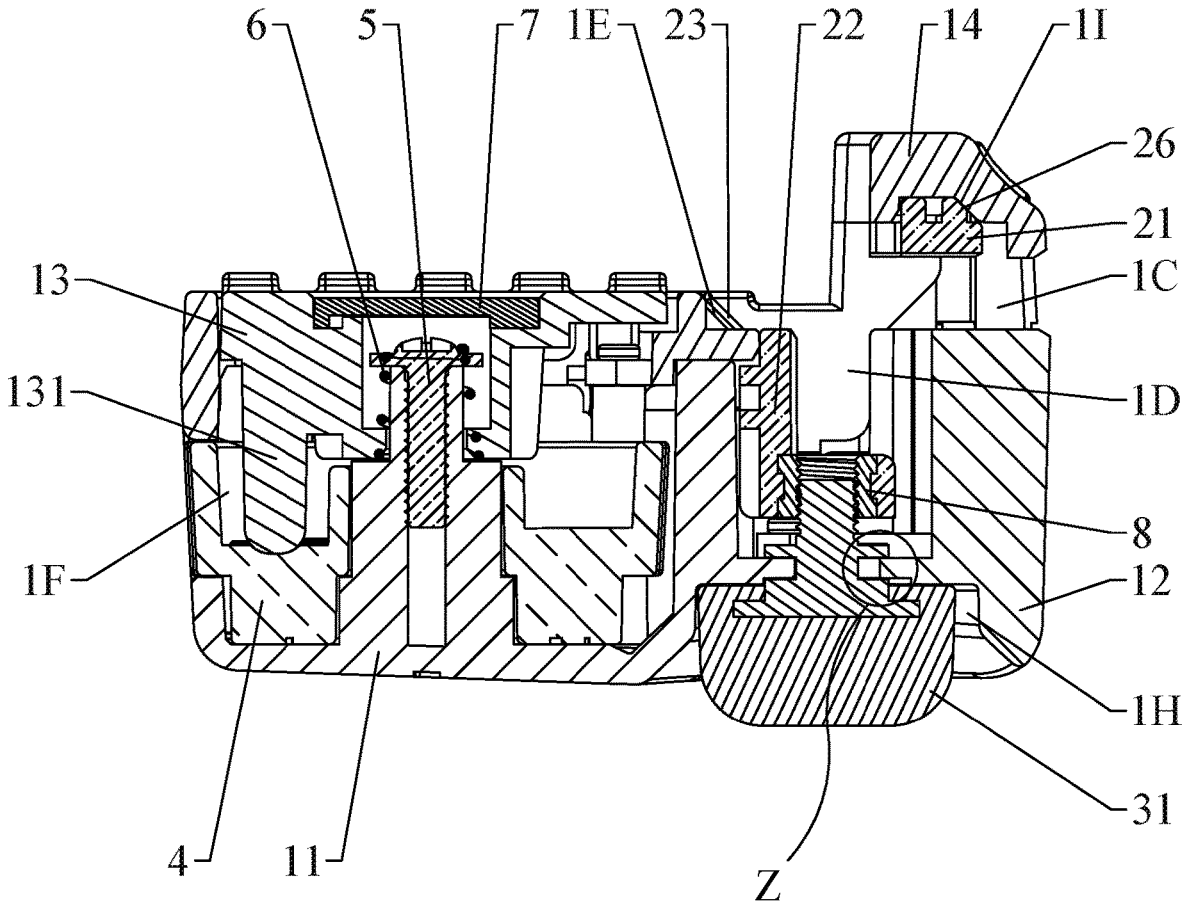
FIG. 5 shows a cross-sectional view of the embodiment of the present invention.
Figure 6:
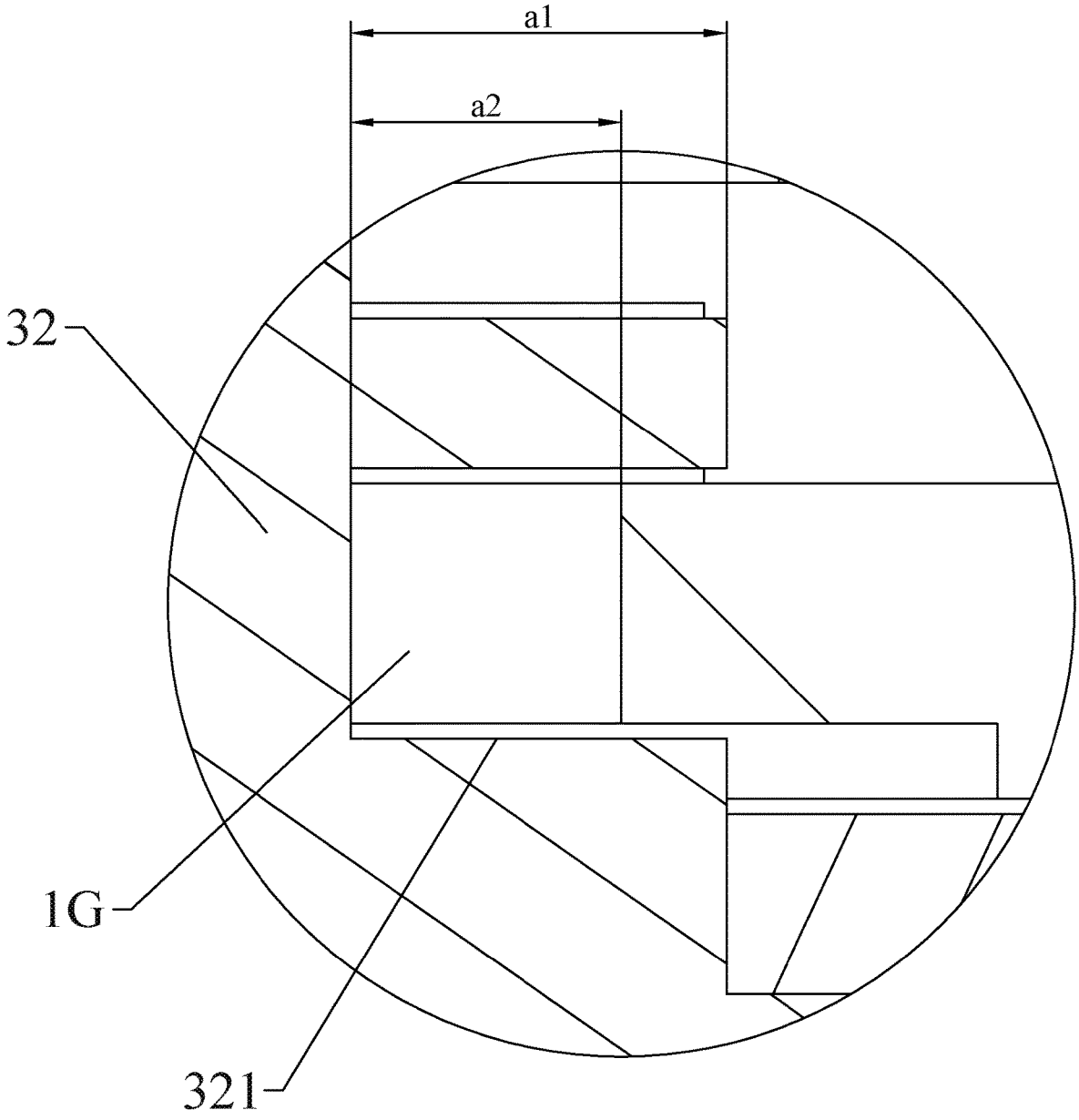
FIG. 6 shows an enlarged view of portion Z in FIG. 5.

According to FIG. 1 to FIG. 6, a specific embodiment of the present invention is shown:

The first through hole 1C extends in a horizontal direction, and the second through hole 1D extends in a vertical direction, so that the first through hole 1C and the second through hole 1D extend in mutually perpendicular directions so as to provide the angles required in snowboard edge tuning under conventional circumstances. The "horizontal direction" and "vertical direction" mentioned above are described with reference to orientations of the snowboard edge tuner as shown in FIG. 5.

The base 1A is formed by a front case 11, a rear case 12, and a front cover 13; the connecting base 1B is formed by a rear cover 14 which covers the front case 11 and the rear case 12; the first through hole 1C and the second inclined surface 1E are provided on the rear cover 14; an upper part and a lower part of the second through hole 1D are respectively provided on the rear cover 14 and the rear case 12. In this embodiment, the front case 11, the rear case 12, the front cover 13 and the rear cover 14 are fixedly connected by fasteners or screws or other connecting structures which are convenient for assembly and disassembly.

Furthermore, the present invention also comprises an adjusting mechanism Y arranged between the front case 11 and the front cover 13 to control a relative angle between the front case 11 and the front cover 13.

An installing chamber 1F is formed between the front case 11 and the front cover 13; the adjusting mechanism Y comprises a second rotating component 4 provided in the installing chamber 1F and also comprises a protruding column 131 provided on a side of the front cover 13 facing the second rotating component 4; the second rotating component 4 is provided with a helical surface 41; the protruding column 131 abuts against different positions of the helical surface 41 during rotation of the second rotating component 4; the front cover 13 is pivoted to the front case 11. When the second rotating component 4 rotates, the protruding column 131 abuts against different positions of the helical surface 41 to adjust a relative tilting angle of the front cover 13 with respect to the front case 11, thereby matching an edge tuning angle of the snowboard. Holes may be opened on a bottom side or a lateral side of the front case 11 such that the second rotating member 4 is exposed for operation after assembly.

Furthermore, a free end of the protruding column 131 is a spherical head 132; the helical surface 41 is provided with a plurality of spherical grooves 411 at equiangular intervals, and the spherical head 132 is movably fitted in different spherical grooves 411 when the second rotating member 4 rotates, so as to provide temporary stoppages of the spherical head 132 in the respective spherical grooves 411 during adjustment of the tilting angle of the front cover 13 with respect to the front case 11 when the second rotating member 4 rotates; the adjusting mechanism Y also comprises a fixed screw 5 provided at a rotating shaft of the second rotating component 4, and a spring 6 provided between an end of the fixed screw 5 and the front cover 13. The spring 6 provides elastic force such that the front cover 13 is biased to the front case 11, thereby realizing installation and reset function of the front cover 13; in addition, a decorative cover 7 may be provided to cover the spring 6 and the fixed screw 5 if necessary.

Two ends of the first pressure plate 21 are connected to two corresponding ends of the second pressure plate 22 through connecting pieces 24 to form the sliding block 2 having an integral structure; the sliding block 2 may be directly molded to obtain such an integral structure during production.

The first pressure plate 21 and the second pressure plate 22 are respectively provided with a first anti-skid pattern 211 and a second anti-skid pattern 221 to strengthen the frictional force between the first pressure plate 21 and the sharpening block 9, and between the second pressure plate 22 and the sharpening block 9, thereby locking the sharpening block 9 more firmly.

The first rotating component 3 comprises a knob 31 and a connecting part 32; the knob 31 covers an end of the connecting part 32; another end of the connecting part 32 is threaded to the sliding block 2. The knob 31 may be made of rubber, silicone or plastic material to save cost and provide a better grip; the connecting part 32 may be made of metal to ensure the connection strength and service life; during production, the connecting component 32 may be formed and placed in a mold, and then the knob 31 is formed at the end of the connecting part 32, ensuring a firm connection between the knob 31 and the connecting component 32.

Furthermore, a bottom side of the second pressure plate 22 is provided with a connecting plate 25, on which a nut 8 is fixedly connected; said another end of the connecting part 32 is threaded to the nut 8. Since the nut 8 is fixedly connected to the connecting plate 25 (and thus to the sliding block 2), when the connecting part 32 (by rotating the first rotating component 3) rotates, the sliding block 2 is driven to move along the second inclined surface 1E.

The second through hole 1D has a reduced diameter portion along its depth, and the reduced diameter portion is defined as a limiting hole 1G; a limiting slot 321 is provided in a middle portion of the connecting part 32; an inner circumferential wall of the second through hole 1D defining the reduced diameter portion is positioned inside the limiting slot 321, so that the first rotating component 3 is axially limited to prevent any axial movement, but may move circumferentially (which means rotation). In this embodiment, a depth a1 of the limiting slot 321 is greater than a diameter difference a2 between the limiting hole 1G and the connecting part 32, so that the connecting part 32 (and thus the first rotating piece 3) moves laterally with the movement of the sliding block 2, without changing the angle of the second pressure plate 22; the connecting part 32 will not be separated from the limiting hole 1G even when the connecting part 32 moves laterally by a maximum distance where a side of the inner circumferential wall of the second through hole 1D defining a diameter of the reduced diameter portion touches the connecting part 32; the limiting hole 1G is located between the front case 11 and the rear case 12; a space 1H allowing the first rotating component 3 to move is provided under the limiting hole 1G, so that the first rotating component 3 moves horizontally and synchronously with the sliding block 2. The first rotating component 3 is fitted at the second through hole 1D as shown in the figures; in another embodiment, by adaptive structural adjustments, the limiting hole 1G may be formed in the first through hole 1C, and hence the first rotating component 3 may be fitted in the first through hole 1C.

The sliding block 2 is provided with a third inclined surface 26 parallel to the first inclined surface 23; the connecting base 1B is provided with a fourth inclined surface 11 slidably cooperative with the third inclined surface 26. The third inclined surface 26 and the fourth slope 11 allow the sliding block 2 to easily reset when being unscrewed by the first rotating component 3. In this embodiment, the fourth inclined surface 11 is on an inner upper surface of the first through hole 1C.

Figure 7:
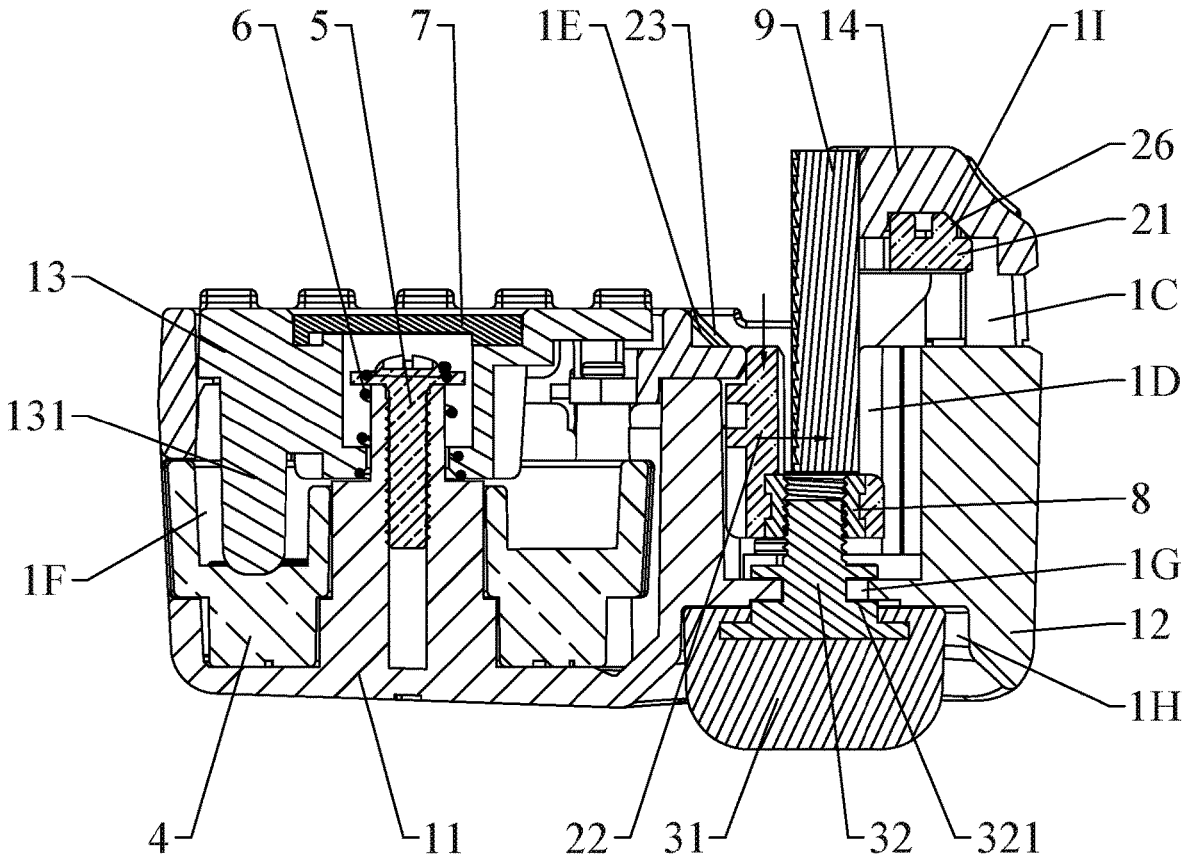
FIG. 7 shows a first schematic view of the embodiment of the present invention during use.
Figure 8:
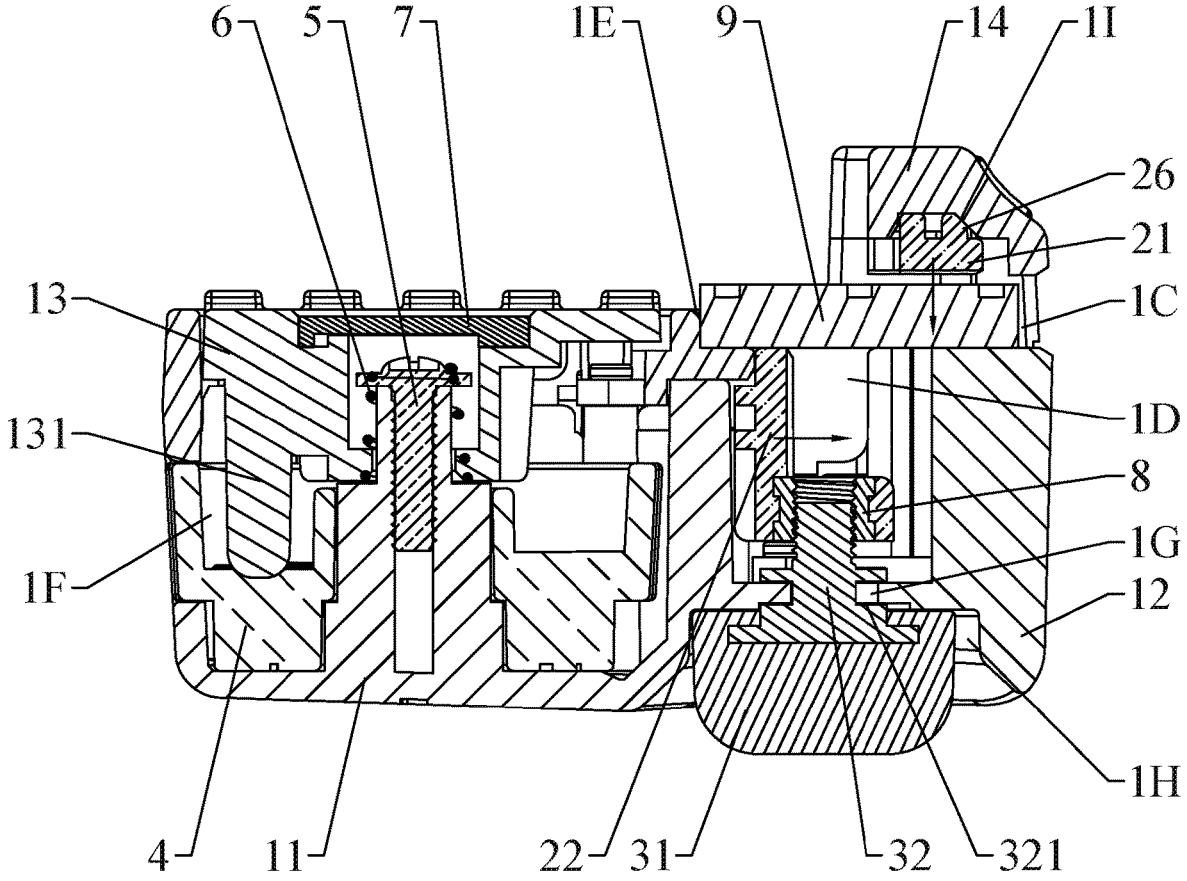
FIG. 8 shows a second schematic view of the embodiment of the present invention during use.

FIG. 7 and FIG. 8 illustrate the working principle of the present invention:

According to FIG. 7, the sharpening block 9 is inserted vertically into the second through hole 1D; the first rotating component 3 is rotated and shortens the distance between the first rotating component 3 and the sliding block 2; the second inclined surface 1E allows the sliding block 2 move downward and to the right (as shown in the figure), so that the sharpening block 9 is pressed against an inner side wall of the second through hole 1D by the second pressure plate 22; hence, a grinding surface of the sharpening block 9 is extends along a vertical direction.

According to FIG. 8, the sharpening block 9 is inserted laterally into the first through hole 1C; the first rotating component 3 is rotated and the distance between the first rotating component 3 and the sliding block 2 shortens; the second inclined surface 1E allows the sliding block 2 move downward and to the right (as shown in the figure), so that the sharpening block 9 is pressed against an inner side wall of the first through hole 1C by the first pressure plate 21; hence, the grinding surface of the sharpening block 9 is extends along a horizontal direction.

In the above scheme, the present invention comprises two positions of assembly of the sharpening block 9 by providing the first through hole 1C and the second through hole 1D on the case 1; the first inclined surface 23 of the sliding block 2 cooperates with the second inclined surface 1E of the case 1, such that when the first rotating component 3 is rotated, the first pressing plate 21 of the sliding block 2 may be driven to fix the sharpening block 9 in the first through hole 1C, or the second pressing plate 22 of the sliding block 2 may be driven to fix the sharpening block 9 in the second through hole 1D; hence, the grinding surface of the sharpening block 9 may face different directions and satisfy different usage requirements.

The above-mentioned embodiments and drawings do not limit the form and style of the present invention. Any appropriate changes or modifications made by those skilled in the art shall also fall within the scope of protection of the present invention.

What is claimed is:

1. A snowboard edge tuner, comprising:

a case and a locking mechanism;

the case comprises a base and a connecting base; the base is connected to the connecting base;

the case also comprises a first through hole passing through the connecting base, and a second through hole passing through both the base and the connecting base; the first through hole and the second through hole are in communication with each other;

the locking mechanism comprises a sliding block and a first rotating component; the sliding block is provided with a first pressure plate movably fitted in the first through hole, a second pressure plate movably fitted in the second through hole, and a first inclined surface slidably cooperative with the base; the base is provided with a second inclined surface slidably cooperative with the first inclined surface; the first rotating component is rotatably fitted on the case, axially limited by the case and further threaded to the sliding block;

when the first rotating component rotates, the first rotating component drives the sliding block to slide along the second inclined surface, such that the first pressure plate is configured to press against a sharpening block disposed in the first through hole, or the second pressure plate is configured to press against the sharpening block alternatively disposed in the second through hole.

2. The snowboard edge tuner of claim 1, wherein the first through hole extends in a horizontal direction, and the second through hole extends in a vertical direction.

3. The snowboard edge tuner of claim 1, wherein the base is formed by a front case, a rear case, and a front cover; the connecting base is formed by a rear cover which covers the front case and the rear case; the first through hole and the second inclined surface are provided on the rear cover; an upper part and a lower part of the second through hole are respectively provided on the rear cover and the rear case.

4. The snowboard edge tuner of claim 3, wherein further comprising an adjusting mechanism arranged between the front case and the front cover to control a relative angle between the front case and the front cover.

5. The snowboard edge tuner of claim 4, wherein an installing chamber is formed between the front case and the front cover; the adjusting mechanism comprises a second rotating component provided in the installing chamber and also comprises a protruding column provided on a side of the front cover facing the second rotating component; the second rotating component is provided with a helical surface; the protruding column abuts against different positions of the helical surface during rotation of the second rotating component; the front cover is pivoted to the front case.

6. The snowboard edge tuner of claim 5, wherein a free end of the protruding column is a spherical head; the helical surface is provided with a plurality of spherical grooves at equiangular intervals, and the spherical head is movably fitted in different spherical grooves when the second rotating member rotates; the adjusting mechanism also comprises a fixed screw provided at a rotating shaft of the second rotating component, and a spring provided between an end of the fixed screw and said front cover; the spring provides elastic force such that the front cover biased to the front case.

7. The snowboard edge tuner of claim 1, wherein the first pressure plate and the second pressure plate are respectively provided with a first anti-skid pattern and a second anti-skid pattern.

8. The snowboard edge tuner of claim 1, wherein the first rotating component comprises a knob and a connecting part; the knob covers an end of the connecting part; another end of the connecting part is threaded to the sliding block.

9. The snowboard edge tuner of claim 8, wherein a bottom side of the second pressure plate is provided with a connecting plate, on which a nut is fixedly connected; said another end of the connecting part is threaded to the nut.

10. The snowboard edge tuner of claim 8, wherein the second through hole has a reduced diameter portion along its depth, and the reduced diameter portion is defined as a limiting hole; a limiting slot is provided in a middle portion of the connecting part; an inner circumferential wall of the second through hole defining the reduced diameter portion is positioned inside the limiting slot.

11. The snowboard edge tuner of claim 10, wherein a depth of the limiting slot is greater than a diameter difference between the limiting hole and the connecting part.

12. The snowboard edge tuner of claim 1, wherein the sliding block is provided with a third inclined surface parallel to the first inclined surface; the connecting base is provided with a fourth inclined surface slidably cooperative with the third inclined surface.

13. The snowboard edge tuner of claim 12, wherein the fourth inclined surface is positioned on an inner upper surface of the first through hole.

* * * * *